United States Patent [19]

Hoffman et al.

[11] Patent Number: 5,070,986

[45] Date of Patent: Dec. 10, 1991

[54] VENDING MACHINE OPERATING MECHANISM

[75] Inventors: Arlan J. Hoffman, 5137 Coldbrook Dr., Mantua, Ohio 44255; Charles P. Crawley, Mentor, Ohio

[73] Assignee: Arlan J. Hoffman, Mantua, Ohio

[21] Appl. No.: 492,824

[22] Filed: Mar. 12, 1990

[51] Int. Cl.[5] ..... G07F 5/04; G07F 11/36

[52] U.S. Cl. ..... 194/237; 194/292; 221/75

[58] Field of Search ..... 194/237, 236, 292; 221/75; 209/913; 198/659, 661; 453/12

[56] References Cited

U.S. PATENT DOCUMENTS

| | | | |
|---|---|---|---|
| 1,673,709 | 6/1928 | Reid et al. | 453/12 |
| 3,840,147 | 10/1974 | O'Neal et al. | 221/75 |
| 3,935,966 | 2/1976 | Pitel et al. | 221/75 |
| 4,436,194 | 3/1984 | Hanley | 194/292 |
| 4,744,490 | 5/1988 | Albright et al. | 221/75 |

FOREIGN PATENT DOCUMENTS

| | | | |
|---|---|---|---|
| 155369 | 9/1952 | Australia | 194/236 |

*Primary Examiner*—F. J. Bartuska

*Attorney, Agent, or Firm*—D. Peter Hochberg; Mark Kusner; Louis J. Weisz

[57] ABSTRACT

A vending device for vending machines comprises a spiral coil connected to a coin-operated mechanism that allows rotation thereof and the connected coil when predetermined coins have been inserted into the mechanism. The loops making up the coil comprise closely spaced neighboring loops, remote from the mechanism, capable of supporting and transporting product to be vended as the coil is rotated, and distantly spaced neighboring loops, incapable of supporting the product. As the coil is turned, product is transported toward the mechanism until it reaches the distantly spaced loops where it drops from the spiral into a chute accessible by the purchaser. The mechanism is rotated by coin receivers that are blocked from rotating by spring-urged pawls unless predetermined coins have been inserted therein, or unless disabling tabs are interposed between the receivers and the pawls. Interposition of appropriate tabs permits price changes to be effected by preventing the pawls from stopping the rotation of coin receivers thus disabled.

10 Claims, 6 Drawing Sheets

VENDING MACHINE OPERATING MECHANISM

TECHNICAL FIELD

This invention relates to product-dispensing mechanisms for coin-operated vending machines. More particularly, this invention relates to coin-operated vending machines that discharge vended products from product-holding and transporting spiral coils, and that allow changes to be made in the number of coins required to activate the machines. Specifically, this invention relates to coin-operated vending machines, the loops of whose product holding and transporting coils are spaced further apart at the product-dispensing front end of the coils, than at their back end, allowing product to be transported to the front end of the machine where it can drop from the coils into a chute accessible to purchasers of the product. In addition, the coin mechanism that allows the coils to be rotated when a predetermined number of coins have been inserted therein, and that includes inactivating means to prevent rotation of the coils in the absence of such coins, is provided with means to selectively disable the inactivating means, thereby allowing changes to be made in the number of coins required to activate the machine.

BACKGROUND OF THE INVENTION

Over the years, coin-operated vending machines have become increasingly popular for a variety of reasons, including the fact that they eliminate any need for human intervention in transacting sales of product. As a consequence, product can be sold at desired locations at any time of the day or night, without the assistance of sales personnel. Such machines are, therefore, of considerable convenience to both the purchaser and seller alike.

One popular version of such machines involves the use of parallel rows of horizontal coils disposed inwardly from the front of the machines, the coils being rotatable upon the insertion of a predetermined number of coins. Packages of the product being vended are held between adjacent loops of the coils and transported to a dispensing point as the coils are rotated.

In some types of such machines, the coils are directly connected to manually operated dispensing mechanisms, rather than to electrically driven linkages operated from a control panel. Manual operation is of considerable advantage since component failure within such a machine normally disables only one product-dispensing coil, rather then making the whole machine inoperable as is frequently the case with the more costly, electrically operated electronic machines.

While the manual machines are generally satisfactory, a drawback has been that the coin mechanisms must be located at the front of the machine for access by the purchaser. Since the spiral coils are directly attached to the mechanisms, it has heretofore been necessary to accomplish discharge of the vended product at the free end of the coils, located at the rear of the machine remote from the coin-operated mechanisms. Location of the dispensing point at the rear of the machine has made it difficult, however, for purchasers to see the product package held by the last loop at a coil's free end, the next package to be dispensed. Although such inability is not of particular significance when all of the product packages in a spiral coil are identical, it creates obvious difficulties when a machine operator desires to place a mixture of product packages in the same coil, since the purchaser then has trouble seeing which product will next be dispensed from the coils.

In some machines, the product described tends to be less of a problem since sufficient space can be provided over the coil to permit relatively clear of observation of the end of the coil. In fact, additional machine height is required to accommodate the longer discharge chute necessary for gravity movement of the product purchased from the rear to the front of the machine for access by purchasers; consequently, such additional space is often available. Nevertheless, such space however provided, is a considerable disadvantage since it results in a larger, heavier, and more expensive machine than would otherwise be required.

A further problem inherent in vending machines equipped with coils directly attached to manual operating mechanisms is that extensive retrofit of the machine is required in instances where a product price change becomes necessary. This is due to the fact that the coin-operated mechanisms are designed to accommodate a particular predetermined group of coins. When a different group of coins is desired, the mechanisms must be replaced and since multiple mechanisms are involved, price changes are a substantial inconvenience.

BRIEF DESCRIPTION OF THE INVENTION

In view of the foregoing, therefore, it is a first aspect of the invention to provide a smaller, more compact and less costly coin-operated vending machine.

A second aspect of this invention is to provide a vending machine furnished with product-transporting coils that allows purchasers to view the product about to be dispensed.

Another aspect of this invention is to furnish a coin-operated vending machine provided with a product-holding and transporting spiral coil that dispenses product from the front, rather than the rear of the coils.

Yet another aspect of this invention is to provide a vending machine furnished with holding and transporting spiral coils with variably spaced loops.

An additional aspect of this invention is to provide a coin-operated vending machine with a coin mechanism that can be readily modified to accept different groups of coins.

A further aspect of this invention is to provide a coin-operated vending machine in which product pricing can be altered without replacing the coin mechanisms.

Still a further aspect of this invention is to provide a coin-operated product release mechanism, whose product release locking means can be selectively disabled.

The preceding and additional aspects of this invention are provided by a product-vending device for a vending machine comprising: a spiral coil, and a rotation mechanism, said coil having a free end and a fixed end and comprising a plurality of continuously connected loops, said fixed end being connected to said mechanism and said coil being rotatable thereby, wherein adjoining loops remote from said mechanism are spaced sufficiently closely to each other to allow product to be supported therebetween and transported by the rotation thereof, while adjoining loops substantially adjacent to said mechanism are spaced sufficiently distantly from each other so as to be incapable of such support, whereby as said mechanism is rotatably operated, product supported by said closely spaced loops is transported from said free end toward said fixed end until it reaches said distantly spaced loops whereat the product falls from said coil.

The preceding and yet other aspects of this invention are provided by a product-vending machine that includes a product-vending device according to the preceding paragraph wherein product falling from said distantly spaced loops is received in a chute that transports it to a purchaser.

The preceding and other aspects of this invention are provided by a spiral coil for a coin-operated vending machine, one end of said coil being connectable to a coin-operated mechanism, wherein said coil comprises a plurality of continuously connected loops, neighboring ones of those of said loops substantially adjacent to said coil's connectable end being spaced sufficiently distantly from each other so as to be incapable of supporting therebetween the product to be vended, while the other neighboring loops of said coils are spaced sufficiently closely to each other to allow said product to be supported therebetween and transported by the rotation of said coil to the distantly spaced loops.

The preceding and further aspects of this invention are provided by a coin mechanism for a vending machine activated when predetermined coins have been inserted therein, and whose activation may be adjusted to respond to different predeterminations of coins comprising: a plurality of rotatable coin holder members; coin holder lock members; and lock member disabling means, said coin holders being free to rotate and thus to activate the mechanism when predetermined coins have been inserted therein but that are engaged by said coin holder lock members and prevented from rotating in the absence of such coins, wherein when a different predetermination of coins is required, said lock member disabling means is interposed between at least some of said coin holder members and said coin holder lock members, preventing said engagement by the members thus interposed, thereby allowing rotation of the coin holder members interposed despite the absence of coins therein, and permitting activation of the mechanism.

The preceding and still additional aspects of the invention are provided by a product-vending device for a vending machine comprising: a spiral coil, and a rotation mechanism, said coil having a free end and a fixed end and comprising a plurality of continuously connected loops, said fixed end being connected to said mechanism and said coil being rotatable thereby, wherein adjoining loops remote from said mechanism are spaced sufficiently closely to each other to allow products to be supported therebetween and transported by the rotation thereof, while adjoining loops substantially adjacent to said mechanism are spaced sufficiently distantly from each other so as to be incapable of such support, and wherein said rotation mechanism comprises: a plurality of rotatable coin holder members; coin holder lock members; and lock member disabling means, said coin holder members being free to rotate and thus to rotate said mechanism and said spiral coil connected thereto when predetermined coins have been inserted therein, but that are engaged by said coin holder lock members and prevented from rotating in the absence of said coins, wherein when a different predetermination of coins is required, said lock member disabling means is interposed between at least some of said coin holder members and said coin holder lock members, preventing said engagement by the members thus interposed, whereby when predetermined coins have been inserted in said coin holder members, said coin holder members are free to rotate, allowing rotation of the mechanism, and causing product supported by said closely spaced loops to be transported toward said fixed end until it reaches said distantly spaced loops whereat the product falls from said coil.

The preceding and yet other aspects of the invention are provided by a coin-operated vending machine that includes a product-vending device according to the preceding paragraph wherein product falling from said distantly spaced loops is received in a chute that transports it to a purchaser.

BRIEF DESCRIPTION OF THE DRAWINGS

The invention will be better understood when reference is had to the following drawings, in which like-numbers refer to like-parts, and in which.

DETAILED DESCRIPTION OF THE INVENTION

Figure 1:
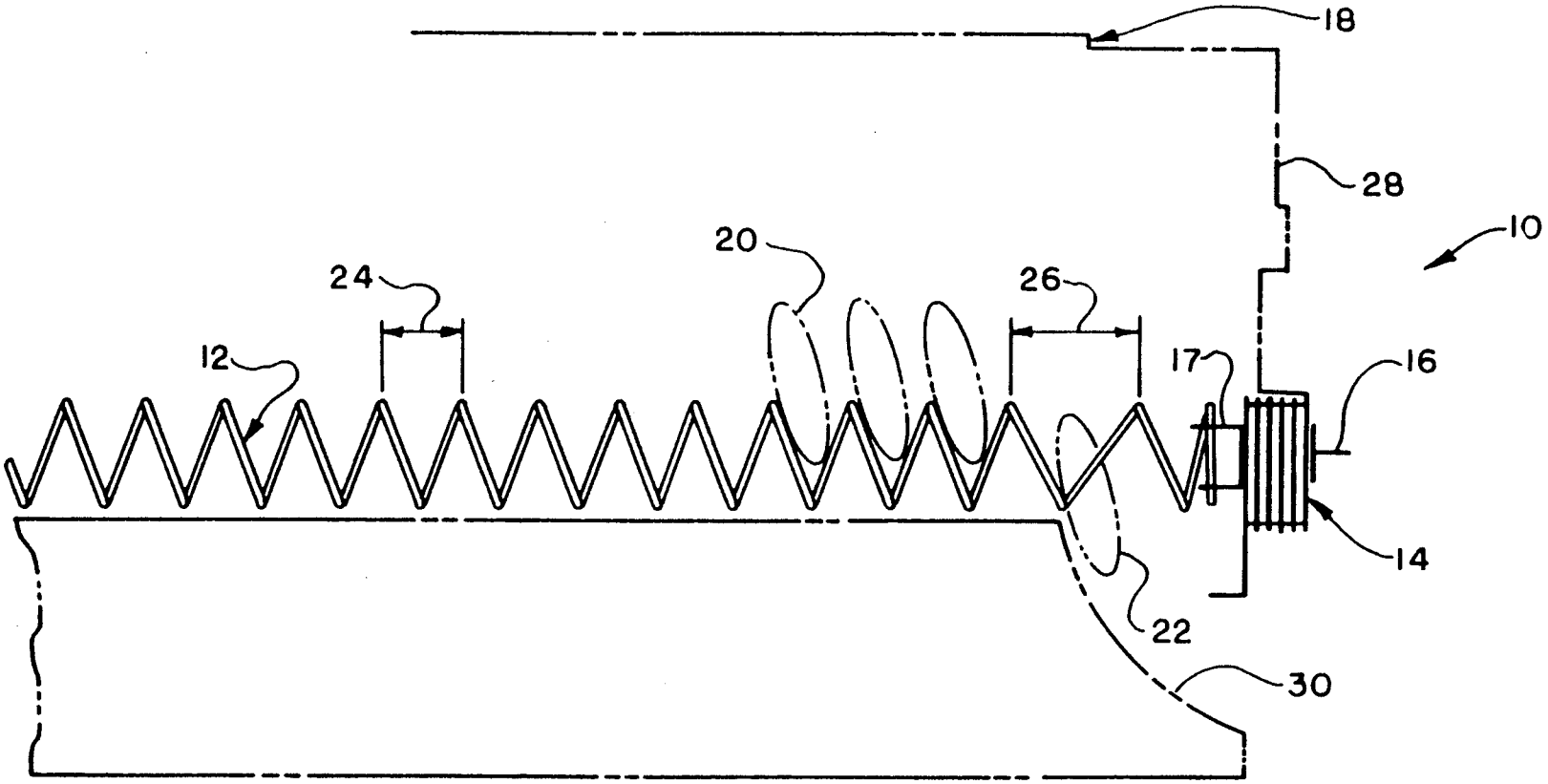
FIG. 1 is a partial sectional view of a vending machine showing the product-vending device of the invention with a phantom representation of product therein and being dispensed therefrom.

FIG. 1 is a partial sectional view of a vending machine showing the product-vending device of the invention with a phantom representation of product therein and being dispensed therefrom.

As shown, the product vending device 10 includes a spiral coil 12 attached by means of a connection bracket 17 to a coin mechanism 14. When a predetermined number of coins have been inserted into the coin mechanism 14, the operating handle 16 may be rotated, causing rotation of the spiral coil 12. As the spiral coil 12 rotates, the product articles being vended 20, illustrated in phantom, are advanced from the free end of the coil on which the articles are supported toward the fixed end of the coil, i.e., the end attached to the coin mechanism 14. The spiral coil is made up of a continuous series of interconnected loops, usually substantially circular, with the loops remote from the coin-operated mechanism being spaced apart by a distance 24 sufficiently close so that the articles 20 are supportably held in the spiral. When, however, the articles 20 reach the loops at the fixed end of the coil 12, which are spaced by a distance 26 sufficiently far apart so that the coil no longer provides support for the articles, gravity causes the articles 22 to fall through the space between neighboring loops onto dispensing chute 30 in the vending machine housing 18 where they can be accessed by a purchaser. The "front-drop" operation of the vending machine 10 permits a purchaser to easily view the packaged article next to be dispensed through viewing window 28.

The dimensions of the loops making up the spiral coils will depend upon the nature of the articles to be vended, the larger the article, the larger the loops; however, in the case of candy bars, for example, the closely spaced loops will be from about 1 inch to 1½ inch apart, with a distance of about 1¼ inch being common. The diameter of such loops will ordinarily be about 1½ inch to 2 inches, a diameter of about 1¾ inches being convenient. In the case of bulkier articles, as for instance small potato chip bags, the dimensions described will be larger, in many cases being up to about 50% larger, or even greater, than the preceding. It will be appreciated that the exact spacing will vary, depending upon the nature of the article to be dispensed, it simply being necessary to select a dimension for the narrower spaced loops sufficient to retain the articles on the spiral coil and to advance them as the spiral rotates, while the configuration of the distantly spaced loops will be chosen so that the vended articles cannot be held thereon, but must fall through such loops. The correct size will be easily determined by trial-and-error methods within the capability of those skilled in the art.

The length of the spiral coil 12 will depend upon the dimensions of the vending machine 18 and the number of articles which the coil is to hold, about 18 to 20 inches being typical. Generally, the spiral coil will be formed from wire, and in such case, the wire will conveniently be provided with a diameter of from about 3/32 inch to ¼ inch.

Figure 2:
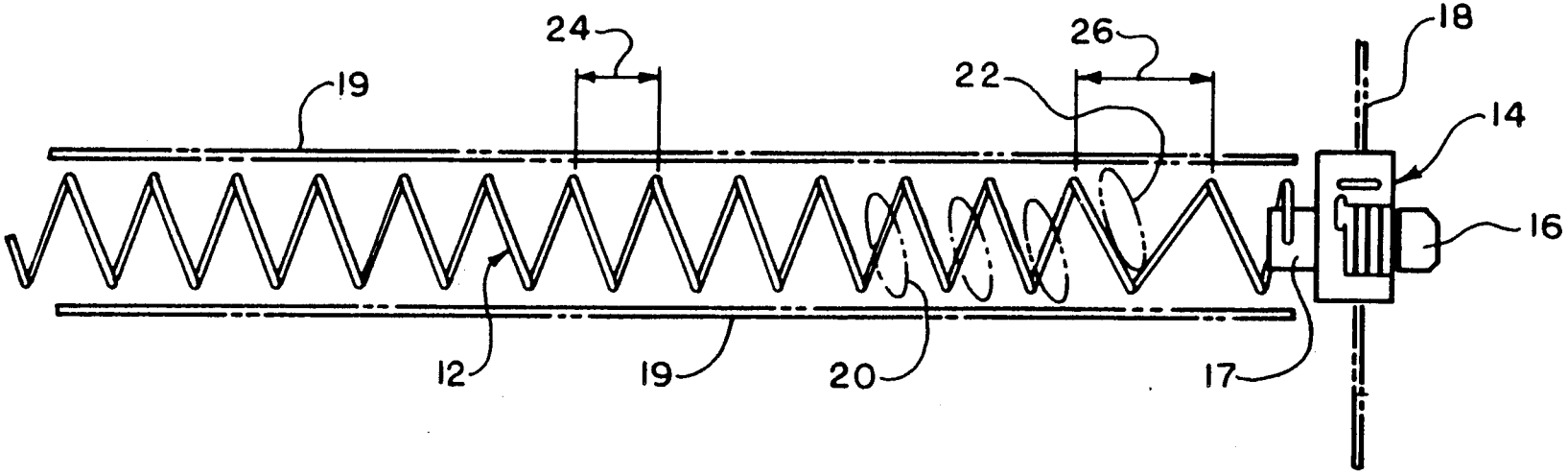
FIG. 2 is a top plan view of the product vending device of FIG. 1, including product aligning partitions disposed on both sides thereof.

FIG. 2 is a top plan view of the product vending device of FIG. 1, including product aligning partitions disposed on both sides thereof. As shown, the spiral coil 12, fastened to the coin mechanism 14 by means of a connection bracket 17 holds the articles 20 in the closely spaced loops 24 thereof. Movable side partitions 19 are provided on either side of the spiral coil 12 to provide lateral support for the articles 20. The Figure also shows an article 22 being dispensed through the distantly spaced loops 26 of the coil. The partitions 17 and coin mechanism 14 are attached to the vending machine housing 18 by means not shown, but which may be any of those known in the art.

The number of distantly spaced loops 26 will depend upon the configuration and disposition of the chute designed to receive the dispensed articles, at least one such distant spacing being necessary, although more than that number may be provided if desired.

Figure 3:
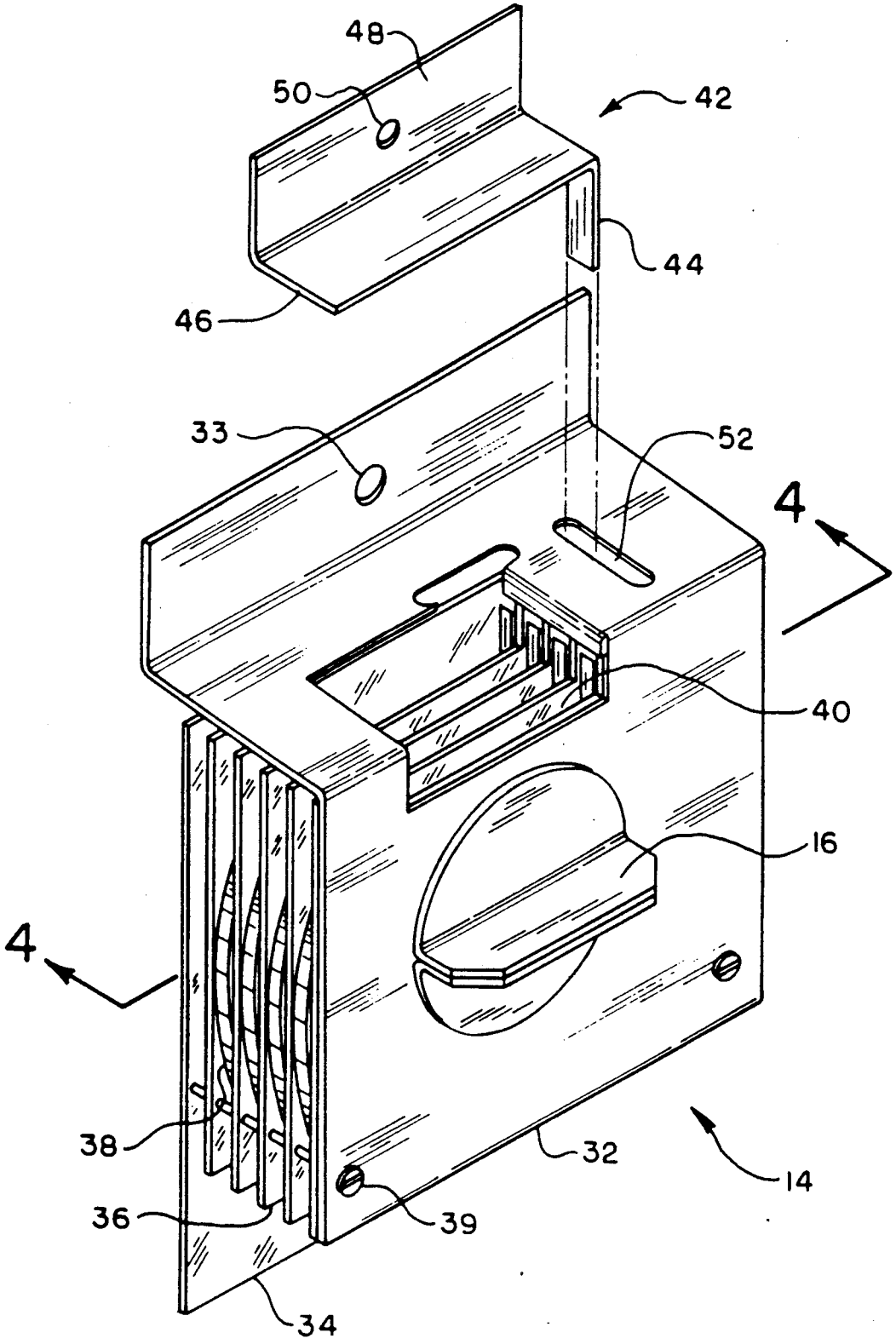
FIG. 3 is a isometric view of a coin mechanism of the invention, including a price adjustment plate associated therewith.

FIG. 3 is an isometric view of a coin mechanism of the invention, including a price adjustment plate associated therewith. In the Figure, a number of coin transport disks 38, interleaved with spacer plates 36 are shown positioned between an exterior housing plate 32 and an interior housing plate 34, the assembly being held together by assembly bolts 39. When predetermined coins have been inserted into coin insertion slots 40, the coin transport disks 38 can be rotated by manipulating the operating handle 16. When it is desired to change the number of predetermined coins required to operate the mechanism 14, a price adjustment plate 42 is fastened to the mechanism so that the plate attachment flange 48 with its fastener hole 50 abuts housing plate fastener hole 33, the two holes providing a means for securing the plate to the mechanism by a fastener, not shown. When so positioned, coin blocking flange 46 is disposed over some of the coin insertion slots, preventing coins from being inserted therein, and pawl interlock tab 44 projects through tab access slot 52, permitting the coin transport disks associated with the inactivated slots to rotate despite the absence of coins therein by means better understood when reference is had to FIG. 7.

When the price adjustment plate 42 has been affixed to the exterior housing plate 32 by a fastener extending through holes 50 and 33, a portion of the vending machine housing 18, not shown, may be disposed over tab access slot 52 and part or all of price adjustment plate 42 to prevent tampering. While four coin slots are shown, more or less than that number may be included in the coin mechanism if desired.

Figure 4:
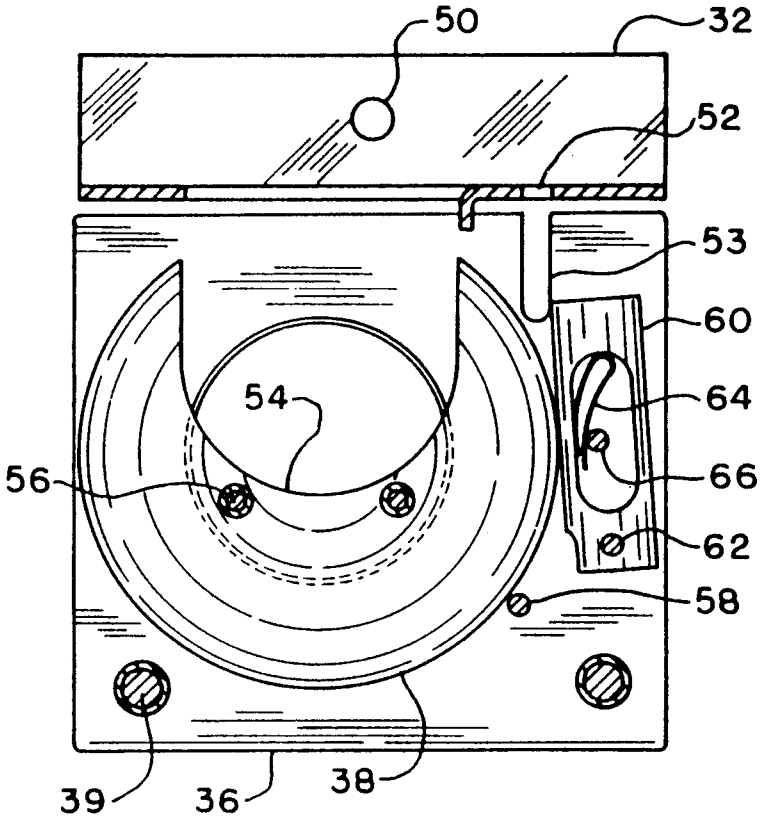
FIG. 4 is a front elevation sectional view of a coin mechanism of the invention along line 4—4 of FIG. 3 in position to receive coins in the coin holder members thereof.

FIG. 4 is a front elevation sectional view of a coin mechanism of the invention along line 4—4 of FIG. 3 in position to receive coins in the coin holder members thereof. As shown, a rotatable coin transport disk 38 is positioned by receiver alignment pins 56, the disk being adjacent to a spacer plate 36 held by assembly bolts 39. Disk guide pin 58 is furnished to assist in guiding the rotation of the disk. Adjacent to the coin transport disk 38 is a pawl 60, pivotal about pawl swivel pin 62. As can be seen, the pawl is provide with a cavity in which is located a spring 64, and a spring pin 66 which cooperates in urging the pawl against the edge of the disk 38. Also to be seen is a portion of exterior housing plate 32, provided with a mounting fastener hole 50 and a tab access slot 52. A tab access slot 53 is also provided in spacer plate 36 for purposes which will be explained in connection with FIG. 7. The dimensions of the components of the coin mechanism shown may be varied, depending among other things upon the nature of the coins to be accommodated.

Figure 5:
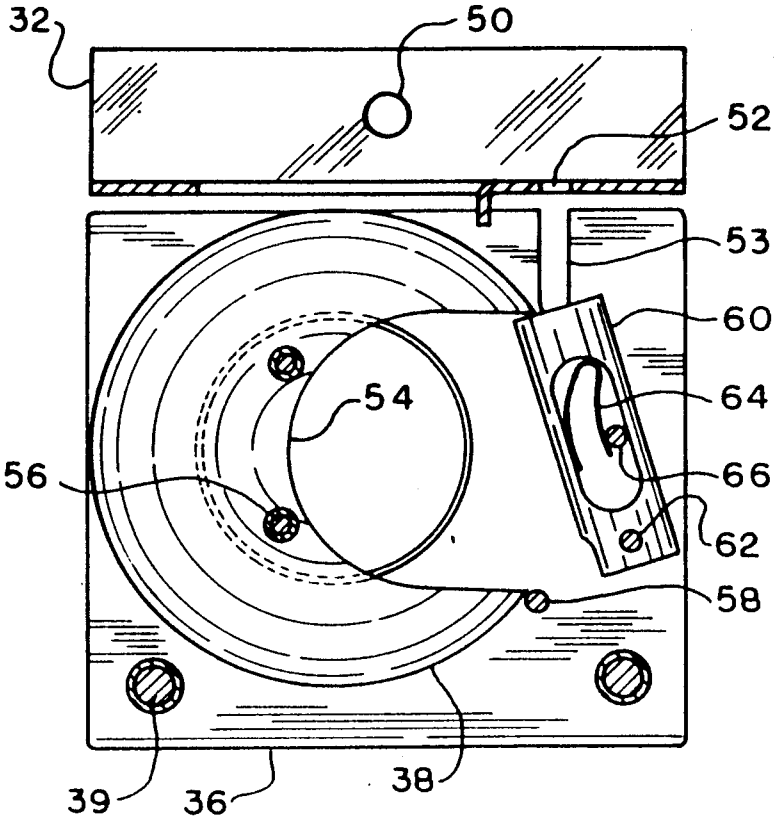
FIG. 5 is a front elevation of a coin mechanism of the invention sectioned as in FIG. 4, showing the locking engagement of the pawl locking members when no coins are contained in the coin holder members.

FIG. 5 is a front elevation of a coin mechanism of the invention sectioned as in FIG. 4, showing the locking engagement of the pawl locking members when no coins are contained in the coin holder members. The Figure illustrates how the coin transport disk 38 is restrained from rotation in the absence of a coin inserted into the coin receiver portion 54 thereof. By way of explanation, if rotation of the coin transport disk 38 is attempted without a coin, the force of pawl spring 64 acting between the cavity of pawl 60 and spring pin 66 urges the pawl to rotate to the left about pawl swivel pin 62, causing the pawl to partially enter the coin receiver portion 54, blocking further movement of the disk. As indicated, the coin transport disk 38 is mounted on receiver alignment pins 56, adjacent to the spacer plate 36 held by assembly bolts 39. Tab access slots 52 of exterior housing plate 32 and tab access slot 53 of the spacer plate play no part in the action shown in the Figure since no price adjustment plate is attached to fastener hole 50.

While a U-shaped pawl spring is shown, other types of springs may be employed for urging purposes, as well as pawls of different shape.

Figure 6:
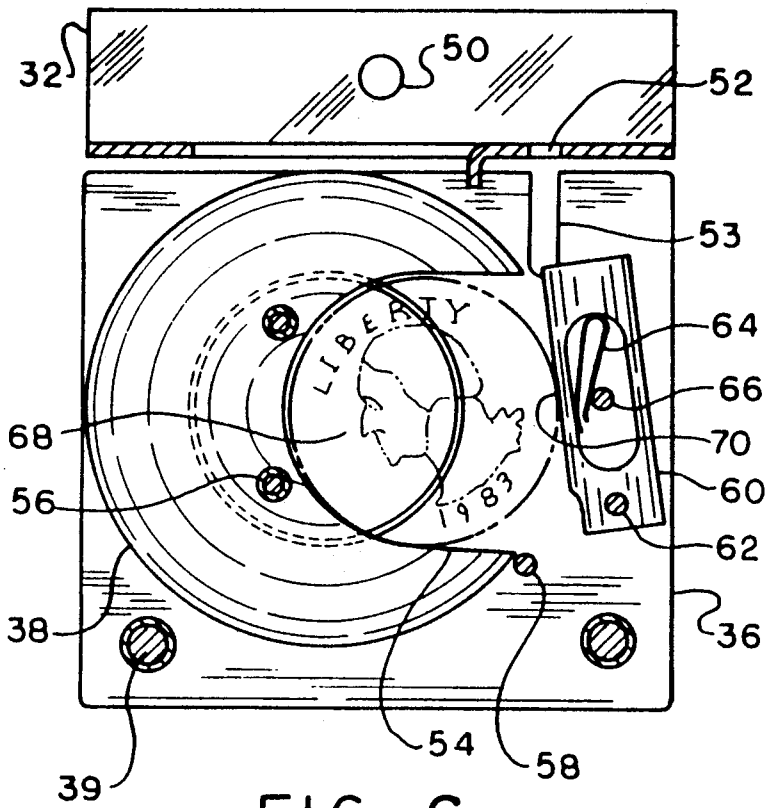
FIG. 6 is a front elevation of a coin mechanism of the invention sectioned as in FIG. 4 showing how the presence of coins contained in the coin holder members prevents the locking engagement of the pawl locking members with the coin holder members.

FIG. 6 is a front elevation of a coin mechanism of the invention sectioned as in FIG. 4 showing how the presence of a coin contained in the coin holder member prevents the locking engagement of the pawl locking members with the coin holder members. The Figure illustrates a coin 68 inserted in the coin receiver portion 54 of a coin transport disk 38 positioned on receiver alignment pins 56, the disk being positioned adjacent the spacer plate 36 held by assembly bolts 39. In the case illustrated by the Figure, pawl 60 is unable to pivot about pawl swivel pin 62 notwithstanding the urging of pawl spring 64 against the inner cavity of the pawl and spring pin 66, due to the contact of the pawl with coin edge 70. Hence the coin transport disk is free to rotate notwithstanding the absence of a pawl interlock tab extending into tab access slot 53 of the spacer plate 36 and access slot 52 of the price adjustment plate 32.

While the Figure shows a twenty-five cent piece inserted in the coin receiver portion 54, the coin receiver portion may be dimensioned to receive different sized coins, and different ones of the coin transport disks may be provided with different sized coin receiver portions if desired.

Figure 7:
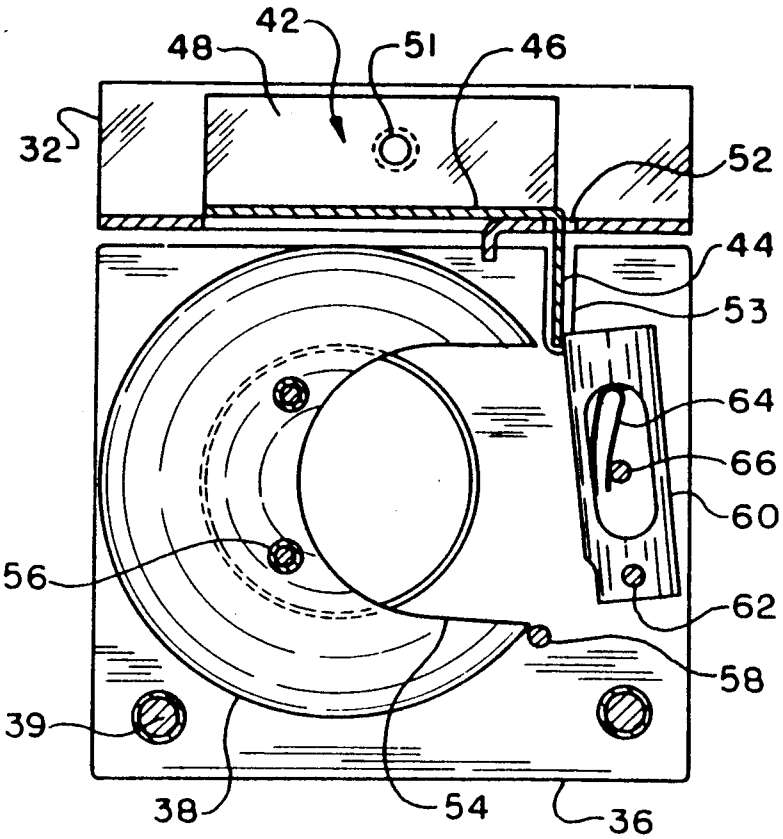
FIG. 7 is a front elevation of a coin mechanism of the invention sectioned as in FIG. 4 showing how the tab of the price adjustment plate prevents the locking engagement of the pawl locking members with the coin holder members.

FIG. 7 is a front elevation of a coin mechanism of the invention sectioned as in FIG. 4 showing how the tab of the price adjustment plate prevents the locking engagement of the pawl locking members with the coin holder members. As illustrated, a price adjustment plate 42 has been mounted on exterior housing plate 32 so that its plate attachment flange 48 abuts the housing plate, while its coin blocking flange 46 extends over a portion of the coin insertion slots, and its pawl interlock tab 44 extends through tab access slots 52 and 53. In such a position, the end of the tab 44 is interposed between pawl 60 and coin transport disk 38. When so positioned, the pawl is incapable of pivoting about pivot swivel pin 62 when urged by pawl spring 64 bearing against spring pin 66 and the edge of the inner cavity of the pawl. Consequently, the coin transport disk 38 mounted on receiver alignment pins 56, adjacent to spacer plate 36, and held by assembly bolts 39 is free to rotate guided by disk guide pin 58, notwithstanding the absence of a coin in coin receiver portion 54.

While the price adjustment plate 42 comprises flanges 48 and 46, meeting at right angles, together with the pawl interlock tab extending at right angles from the coin blocking flange 46, different flange shapes can be employed so long as they include a tab extending downward into tab access slots 52 and 53.

With respect to the coin transport disks 38, their thickness will be sufficient to receive the thickness of the coins to be inserted therein. In the case of twenty-five cent pieces, this requires the disks to be about ⅛ inch thick. Similarly, the width of the blocking tab 44, better seen in connection with FIG. 3, must be wide enough to extend across those disks that it is intended to disable. For example, assuming that the coin receiver portions and transport disks are dimensioned to receive twenty-five cent pieces, a pawl interlock tab 44 intended to disable a single pawl opposite one of the disks should be about ⅛ inch wide, while a tab intended to disable pawls opposite two of such disks will be about ¼ inch wide.

Figure 8:
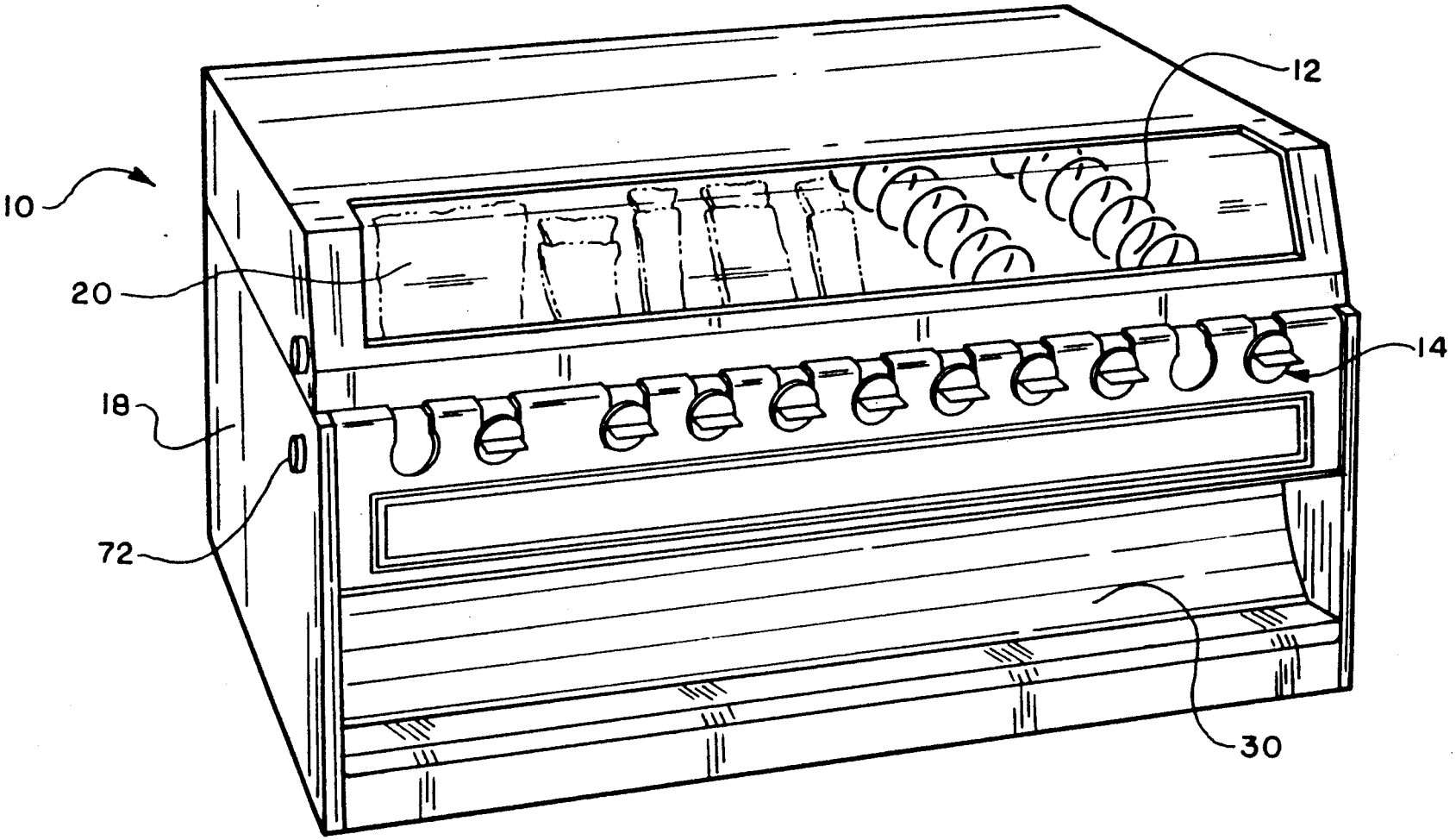
FIG. 8 is an isometric view of a coin-operated vending machine that includes product-vending devices of the invention.

FIG. 8 is an isometric view of a coin-operated vending machine that includes product-vending devices of the invention. In the Figure, a vending machine 10 is shown which includes coin mechanisms 14 attached to spiral coils 12. The housing 18 is divided into an upper and a lower section, hinged together, and secured by means of housing locks 72. Various rows of vendable articles 20 dispensable through chute 30 are to be seen.

One of the notable advantages of the front-drop vending machines made possible by the vending devices of the invention is that small, compact vending machines are possible since additional height is not required to view vended articles at the rear of the machine. Vending machines of the type illustrated in the Figure can typically have dimensions about 15 inches high, 28 inches wide, and 21 inches deep. Such a machines can also be lightweight, for example, about 70 pounds. Although small machines of the type illustrated provided with single product tiers have unique advantages, multiple tiers can be provided for the vended product, and as previously described, by suitable adjustment of the product partitions 19 and the provision of different size spiral coils, a variety of products can be accommodated, for example, pastries, potato chips, and candy, among others.

While in accordance with the patent statutes, a preferred embodiment and best mode has been presented, the scope of the invention is not limited thereto, but rather is measured by the scope of the attached claims.

What is claimed is:

1. A product-vending device for a vending machine comprising:

a spiral wire coil, and a rotation mechanism, said coil having a free end and a fixed end and consisting of a plurality of continuously connected helical loops, said fixed end being connected to said mechanism, and said coil being rotatable thereby, wherein adjoining loops remote from said mechanism are spaced sufficiently closely to each other to allow product to be supported therebetween and transported by the rotation thereof, while the periphery of a loop forming a complete circular helix substantially adjacent to said mechanism is stretched sufficiently apart so as to be incapable of supporting said product, whereby as said mechanism is rotatably operated, product supported by said closely spaced loops is transported from said free end toward said fixed end until it reaches said stretched loop whereat the product falls therethrough.

2. A product-vending device according to claim 1 in which the rotation mechanism is a coin releasable mechanism that cannot be rotated until predetermined coins have been inserted therein.

3. A coin-operated vending machine that includes a product-vending device according to claim 1 wherein product falling through said stretched loop is received in a chute that transports it to a purchaser.

4. A coin mechanism for a vending machine activated when predetermined coins have been inserted therein, and whose activation may be adjusted to respond to different predeterminations of coins comprising:

a plurality of rotatable coin holder members;

coin holder lock members; and a unitary lock member disabling means, said coin holders being free to rotate and thus to activate the mechanism when predetermined coins have been inserted therein, but that are engaged by said coin holder lock members and prevented from rotating in the absence of said coins, wherein when a different predetermination of coins is required, said lock member disabling means is interposed between at least some of said coin holder members and said coin holder lock members, preventing said engagement by the members thus interposed, thereby allowing rotation of the coin holder members interposed despite the absence of coins therein, and permitting activation of the mechanism.

5. A coin mechanism according to claim 4 wherein said coin holder lock members are pivotable pawls urged by spring means to engage recesses for coins in said coin holders when not restrained by means selected from the group consisting of the edges of coins inserted in said slots, and said unitary lock member disabling means.

6. A coin mechanism according to claim 5 wherein said lock member disabling means comprises a unitary interlock tab adapted for insertion between said pawls and said recesses, associated with the coin holder members which it is desired to disable.

7. A coin mechanism according to claim 6 wherein said tab is connected to a plate removably attachable to a housing enclosing said coin holder members and said coin lock members, a free end of said tab extending into the interior of said housing, between some of said coin holder members and said coin lock members.

8. A product-vending device for a vending machine comprising:

a spiral wire coil, and a rotation mechanism, said coil having a free end and a fixed end and consisting of a plurality of continuously connected helical loops, said fixed end being connected to said mechanism and said coil being rotatable thereby, wherein adjoining loops remote from said mechanism are spaced sufficiently closely to each other to allow product to be supported therebetween and transported by the rotation thereof, while adjoining loops substantially adjacent to said mechanism are spaced sufficiently distantly from each other so as to be incapable of such support, and wherein said rotation mechanism comprises:

a plurality of rotatable coin holder members;

a unitary lock member disabling means, said coin holder members being free to rotate and thus to rotate said mechanism and said spiral coil connected thereto when predetermined coins have been inserted therein, but that are engaged by said coin holder lock members and prevented from rotating in the absence of said coins, wherein when a different predetermination of coins is required, said lock member disabling means is interposed between at least some of said coin holder members and said coin holder lock members, preventing said engagement by the members thus interposed, whereby when predetermined coins have been inserted into said coin holder members, said coin holder members are free to rotate, allowing a rotation of the mechanism, and causing product supported by said closely spaced loops to be transported toward said fixed end until it reaches said distantly spaced loops whereat the product falls through said distantly spaced loops from said coil.

9. A coin-operated vending machine that includes a product-vending device according to claim 8 wherein product falling from said distantly spaced loops is received in a chute that transports it to a purchaser.

10. A coin mechanism for a vending machine activated when predetermined coins have been inserted therein, and whose activation may be adjusted to respond to different predeterminations of coins comprising:

a plurality of rotatable coin holder members;

coin holder lock members; and lock member disabling means, said coin holders being free to rotate and thus to activate the mechanism when predetermined coins have been inserted therein, but that are engaged by said coin holder lock members and prevented from rotating in the absence of said coins, wherein when a different predetermination of coins is required said lock member disabling means is interposed between at least some of said coin holder members and said coin holder lock members, preventing said engagement by the members thus interposed, thereby allowing rotation of the coin holder members interposed despite the absence of coins therein, and permitting activation of the mechanism, wherein said coin holder lock members are pivotable pawls urged by spring means to engage recesses for coins in said coin holders when not restrained by means selected from the group consisting of the edges of coins inserted in said slots, and lock member disabling means, and wherein said lock member disabling means comprises a tab adapted for insertion between said pawls and said recesses associated with the coin holder members which it is desired to disable, and wherein said tab is connected to a plate removably attachable to a housing enclosing said coin holder members and said coin lock members, a free end of said tab extending into the interior of said housing, between some of said coin holder members and said coin holder lock members.

* * * * *